United States Patent [19]

Cotter

[11] Patent Number: 4,583,339

[45] Date of Patent: Apr. 22, 1986

[54] ROOFING AND SIDING SYSTEM

[76] Inventor: Donald P. Cotter, 18516 - 142nd Ave., NE., Bldg. G, Woodinville, Wash. 98072

[21] Appl. No.: 449,027

[22] Filed: Dec. 13, 1982

[51] Int. Cl.[4] ..... E04D 1/36; E04C 1/34

[52] U.S. Cl. ..... 52/466; 52/463

[58] Field of Search ..... 52/466, 461, 460, 463, 52/522

[56] References Cited

U.S. PATENT DOCUMENTS

| | | | |
|---|---|---|---|
| 1,458,386 | 6/1923 | Bonsall | 52/466 |
| 2,234,799 | 3/1941 | Eason | 52/466 |
| 2,408,557 | 10/1946 | Huntington | 52/466 |
| 2,855,871 | 10/1958 | Huntington | 52/461 |
| 4,117,638 | 10/1978 | Kidd | 52/466 |
| 4,184,299 | 1/1980 | East | 52/466 |
| 4,400,924 | 8/1983 | Andrews | 52/466 |

FOREIGN PATENT DOCUMENTS

| | | | |
|---|---|---|---|
| 1262001 | 4/1961 | France | 52/466 |
| 332402 | 10/1958 | Switzerland | 52/466 |

*Primary Examiner*—Alfred C. Perham

*Attorney, Agent, or Firm*—Townsend & Townsend

[57] ABSTRACT

A sheet metal roofing system 10 comprising pan 11, bracket 21 and batten 31 sections is disclosed. The system covers a given surface 60 with a minimum amount of material while providing two mated surfaces 12 and 13 for sealing the sections together. The absence of fasteners from the exposed surfaces allows them to expand and contract in response to changing temperatures. The pans have rolled edges 15 to provide increased strength and a better fit with the brackets 21.

1 Claim, 8 Drawing Figures

ROOFING AND SIDING SYSTEM

BACKGROUND OF THE INVENTION

1. Field of the Invention

The present invention relates to systems for roofing or siding and more particularly to such a system comprising elongate planar sheets and battens.

2. Description of the Prior Art

Sheet metal and batten roofing systems are well known. Representative systems include U.S. Pat. Nos. 4,001,995 to the present applicant, and 2,855,871 to Huntington. Those systems generally utilize numerous elongate planar sheets which are placed side-by-side to cover the exposed surface of a building. Battens are snapped over the joints between the sheets to provide weatherproofing. In the prior art systems rain water seeps upward by capillary action along the insides of the battens, and since the adjacent edges of the sheets do not meet, the water may penetrate through to the building. It is difficult to place the sheets in the prior art around angles, at the peak of a roof for example, where a break or seam may cause the weatherproofing to fail. When the sheets are attached to a building and exposed to the sun, differential expansion can buckle them. Prior art systems are either less moisture proof or use more material per square foot, and hence are less desirable than the present invention.

SUMMARY OF THE INVENTION

It is an object of this invention to provide a more economical and moisture-proof roofing or siding system than previously known. The invention combines generally planar strips or "pans" having their long edges turned up to form legs, a hold-down bracket which fits over the legs and serves as a pan spacer, and a batten cap which fits over the bracket and is sealable to the pans. The bracket also is sealable to the pans for added moisture protection, or an intermittent bracket may be used for economy. Vertical gutters along the length of the pans are preferably included to channel water away from the seams along the brackets. The unusually long continuous lengths of pans and batten caps which are possible with this system, and the absence of any fasteners or holes in the exposed surfaces make this system an elastic membrane which expands and contracts thermally. The invention maintains moisture protection while using less material per square foot than does the prior art. The novel features and further objects of the invention will be better understood from consideration of the following description and drawings in which a preferred embodiment of the invention is illustrated. The drawings are for illustration only and are not intended as limits of the invention.

DETAILED DESCRIPTION OF THE PREFERRED EMBODIMENT

Figure 1:
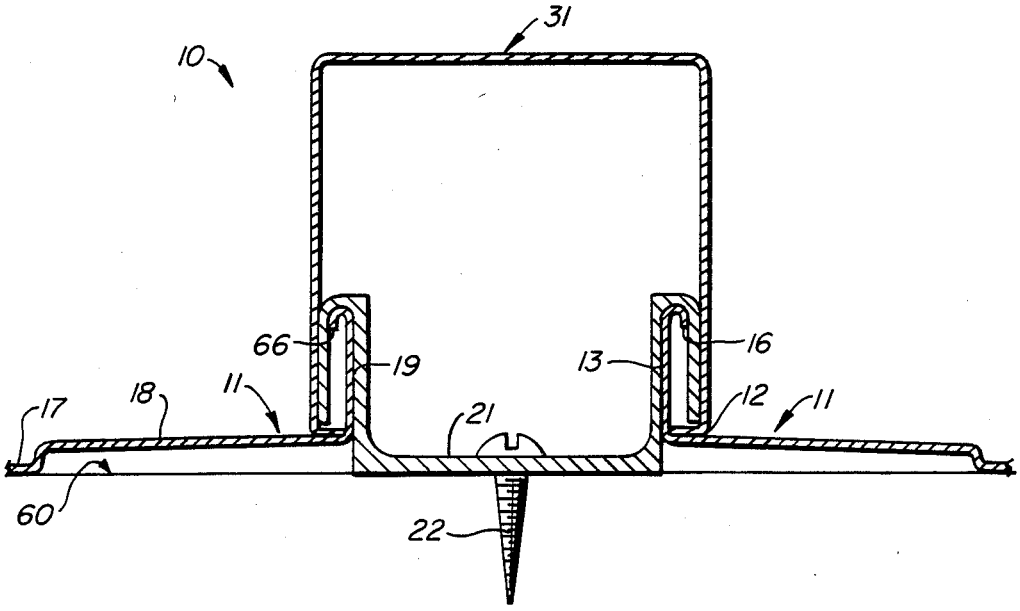
FIG. 1 is a section across a joint in the roofing system of the present invention showing a hold-down bracket, part of two pan sections, and a batten cap.
Figure 2:
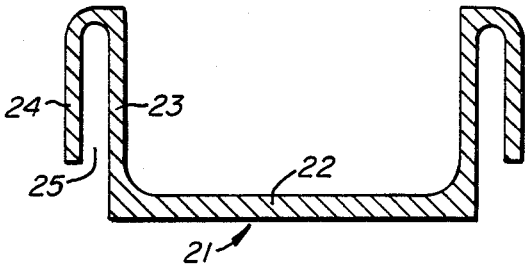
FIG. 2 is a cross-section of a hold-down bracket.

Referring to FIG. 1, the system 10 comprising repetitions of pan strip 11, hold-down bracket 21, and batten cap 31 is anchored to a building framework or surface 60. Although the following description refers to a "roof" system, system 10 can be used either as roofing or siding, or both. The roof is constructed by first placing two pan strips 11 adjacent to each other on a building surface 60 to be covered and then installing hold-down brackets 21 using conventional fasteners such as screw 22. The length of pan 11 is oriented vertically for siding, and perpendicular to the horizontal for roofing. Bracket 21, shown in FIG. 2, is typically extruded aluminum alloy and may be intermittent or continuous along the length of pan 11, depending on the degree of moisture protection required. For a steeply pitched roof in a moderately wet environment, bracket 21 may be two inches long and repeated intermittently. In more severe climates of heavy snow and ice or on less steeply pitched roofs, a continuous bracket contributes improved moisture protection and greater mechanical strength. When a continuous bracket 21 is used, a conventional type sealant or caulking 13 may be applied to the outside of pan leg section 19 along area 13, shown as a line in the cross-sections, before bracket slot 25 is fit over rolled edge 15.

After a roof-length of bracket 21 is anchored, another pan strip 11 is placed parallel to vertical leg 20 on the opposite side of either pan strip 11, and another hold-down bracket 21 is installed in like fashion.

Pan 11 comprises panel 18 which is at a slight angle $\theta$ to the plane of the building surface 60. Along its length, pan 11 has a trough 17 running parallel to and mid-way between legs 19 and 20. Angled panel 18 and trough 17 together form a vertical gutter system that, on a roof, channels water diagonally away from bracket 21 for additional waterproofing. Vertical gutters have not previously been used.

Figure 3:
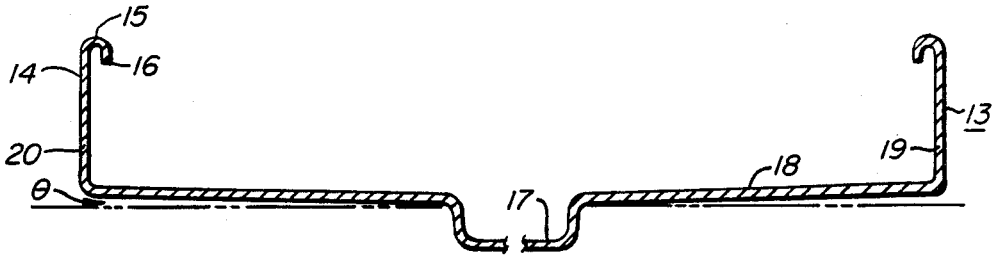
FIG. 3 is a cross-section of a pan.

Prior art batten roofing systems, for example the patent to Huntington, use brackets holding down vertical side legs of pan sections. In prior art systems, vertical pan legs have an unfinished sharp flat edge which causes several problems. The pan strip is cut to some tolerance at a mill prior to forming. The tolerance creates vertical pan legs of variable height ending somewhere comparable to point 14 in FIG. 3. If the prior art pan leg is short, it will not be clamped snugly by its hold-down bracket, and the looseness allows moisture to penetrate. If the pan leg is long, then the bracket can be screwed down only with difficulty, crimping the leg and if not immediately distorting, then at least pinching the pan and preventing thermal expansions and contraction so that the pan buckles. As shown in FIG. 3, rolled edge 15 in the present invention creates a very carefully controlled leg height to the middle of the roll. Excess pan material may extend beyond point 16, to point 66 in FIG. 1 for example, with no adverse effect.

Rolled edge 15 increases the rigidity of pan section 11 and is normally sufficient to prevent the pan from buckling and distorting during handling and installation. If longer lengths of pan are desired than can be transported in finished form, then mobile equipment can be used at the construction site to form rolls of sheet metal into pans and batten caps. Using mobile equipment, continuous roof panels up to one mile long are practical. Finally, rolled edge 15 eliminates the hazard to workers of cuts during handling and installation.

Figure 4:
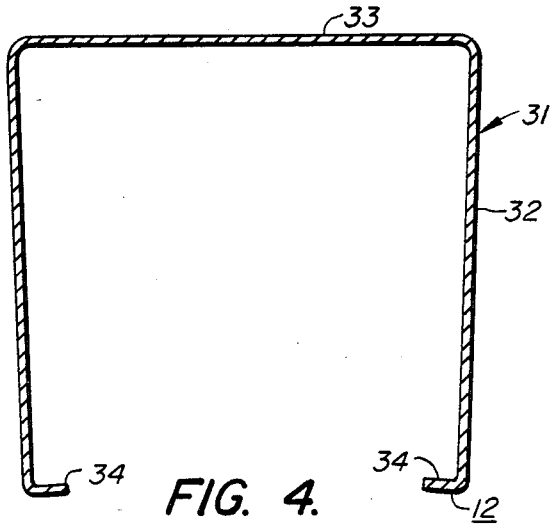
FIG. 4 is a cross-section of a batten cap.

After hold-down bracket 21 has been secured to the underlying roof 60, a batten cap 31 as shown in FIG. 4 is installed. Cap 31 is made of resilient material such as sheet metal or plastic, and is over-formed. The sides 32 of the cap are pulled apart to permit the flanges 34 to span the outer legs 24 of bracket 21. As the flanges 34 of the cap clear legs 24, the cap is released and springs shut around the bracket. In less severe climates where the moisture protection of sealant along area 13 is not required, or where brackets 21 are not continuous, sealant may be more economically applied along area 12 between the cap and the pan. If sealant is used at 12 but not at 13, then the pan and cap, which are the only exposed parts, can slide together relative to the bracket to allow for expansion and contraction of the sheets when exposed to the sun. Differential expansion and buckling are avoided. For the greatest moisture protection sealant can be applied along both areas 12 and 13. The invention provides two mated sealing surfaces while prior art systems using a comparable amount of material per square foot provide none.

In the invention the longer sides 32 of the battens 31 are generally parallel. As a result, the battens can be used to span angles between roof sections, as illustrated in FIGS. 5 and 6.

Figure 5A:
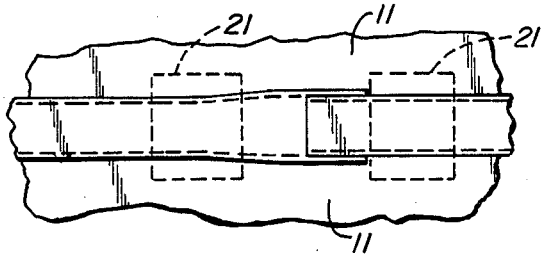
FIGS. 5A and 5B are plan and side views illustrating how the roofing system of FIG. 1 spans the peak of a roof.
Figure 5B:
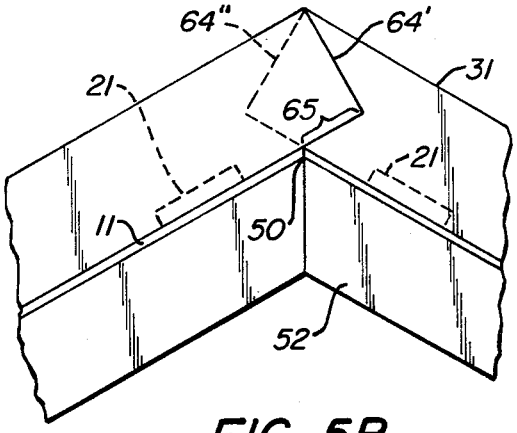

FIGS. 5A and 5B illustrate pan sections 11 spanning the peak 50 of roof 52. The sheets are anchored to roof 52 by brackets 21. The longer sides of batten 31 are cut at 64' and 64'' in FIG. 5B, flange 34 is cut from batten 31 on both sides along line 65, and batten 31 is folded so that its longer sides 32 partially overlap. In this configuration, batten 31 can be slipped over the co-planar legs on brackets 21 to provide a continuous batten structure.

Figure 6A:
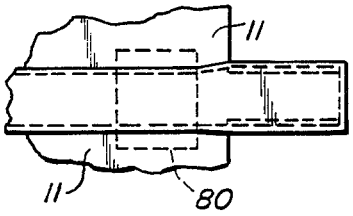
FIGS. 6A and 6B are plan and side views showing the roofing system of FIG. 1 mounted to surfaces intersecting at angles greater than 270°.
Figure 6B:
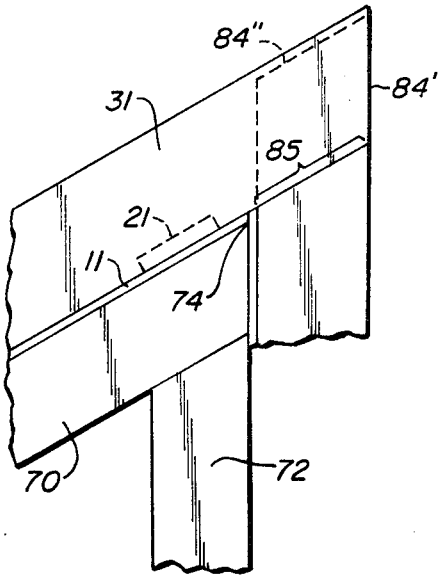

A similar application of the invention is illustrated in FIGS. 6A and 6B. Roof 70 meets side wall 72 in an exposed angle at 74 greater than 270°. Again, pan strips 11 are placed side-by-side and anchored to roof 70 by brackets 21. The longer sides 32 of batten 31 are cut at 84' and 84'', flange 34 is cut away on both sides of the cap along line 85, and the batten is folded over itself. To fold the batten in excess of 90° a wedge shaped portion having an angle at least equal to the excess must be cut from line 84. Batten 31 provides a weatherproof connection between sheets 11.

A preferred embodiment has been illustrated in detail, modifications and adaptations of which will occur to those skilled in the art. However, such modifications and adaptations are within the spirit and scope of the present invention, as limited only by the following claims.

What is claimed is:

1. A roofing and siding system for mounting to a building surface comprising:

a plurality of longitudinal pans having substantially flat central panels, for mounting against the building surface, and lateral borders, the borders including upwardly extending pan legs having short rolled upper lips and border panels tapering upwardly and outwardly away from the building surface as said border panels extend from the central panel to the pan legs, the length of the rolled upper lips being substantially less than the length of the pan legs;

a longitudinal hold-down bracket having a base for mounting to the building surface, upwardly extending inner legs and downwardly extending outer legs defining a bracket slot between the outer and inner legs sized for receipt of the pan legs therein, the outer legs extending a substantial distance past the rolled outer edges of the pan legs and defining a bottom flange gap between the outer legs' distal ends and the underlying border panels; and a longitudinal batten cap sized to cover the hold-down bracket and pan legs, the batten cap having opposed, laterally extending, single thickness flanges positioned for mounting within the batten flange gap, the batten flange gap sized for complementary mating engagement of the single thickness flanges therein with the flanges occupying a substantial portion of the batten flange gap.

* * * * *